United States Patent [19]

Brown

[11] Patent Number: 4,582,005

[45] Date of Patent: Apr. 15, 1986

[54] FUEL BURNING METHOD TO REDUCE SULFUR EMISSIONS AND FORM NON-TOXIC SULFUR COMPOUNDS

[75] Inventor: Melvin H. Brown, Freeport, Pa.

[73] Assignee: Aluminum Company of America, Pittsburgh, Pa.

[21] Appl. No.: 681,439

[22] Filed: Dec. 13, 1984

[51] Int. Cl.[4] ..... F23D 1/00

[52] U.S. Cl. ..... 110/347; 110/263; 110/342; 110/343; 110/345

[58] Field of Search ..... 110/263, 229, 347, 342, 110/343, 344, 345

[56] References Cited

U.S. PATENT DOCUMENTS

| | | | |
|---|---|---|---|
| 1,007,153 | 10/1911 | Spurrier . | |
| 1,167,471 | 1/1916 | Barba . | |
| 1,545,620 | 7/1925 | Trent . | |
| 1,955,574 | 4/1934 | Benner et al. | 110/28 |
| 2,800,172 | 7/1957 | Romer et al. | 158/1 |
| 3,228,451 | 1/1966 | Fraser et al. | 158/117.5 |
| 3,313,251 | 4/1967 | Jonakin | 110/7 |
| 3,540,387 | 11/1970 | McLaren et al. | 110/1 |
| 3,717,700 | 2/1973 | Robison et al. | 423/244 |
| 4,102,277 | 7/1978 | Wall | 110/342 |
| 4,144,017 | 3/1979 | Barsin et al. | 431/10 |
| 4,232,615 | 11/1980 | Brown | 110/342 |
| 4,241,722 | 12/1980 | Dickinson | 126/263 |
| 4,253,409 | 3/1981 | Wormser | 110/347 |
| 4,407,206 | 10/1983 | Bartok et al. | 110/347 |

*Primary Examiner*—Edward G. Favors

*Attorney, Agent, or Firm*—Andrew Alexander; John P. Taylor

[57] ABSTRACT

A combustion process is disclosed for burning a fuel containing sulfur characterized by low sulfur and particulate emission and formation of solid, non-toxic sulfur compounds. The process comprises mixing the sulfur containing fuel with an additive capable of reacting with sulfur; burning the mixture in a first combustion stage with less than 75% theoretical air and at a temperature below the melting point of the ash, but sufficiently high to cause reaction between the additive and any sulfur in the fuel to facilitate removal of the sulfur compounds formed; passing combustible fuel gases and particulates from the first stage to one or more further stages to complete the combustion of the fuel; and oxidizing, in a separate zone, sulfur compounds formed in the first reaction zone by reaction between the additive and the sulfur in the fuel to form non-toxic sulfates.

8 Claims, 2 Drawing Figures

FUEL BURNING METHOD TO REDUCE SULFUR EMISSIONS AND FORM NON-TOXIC SULFUR COMPOUNDS

BACKGROUND OF THE INVENTION

1. Technical Field of the Invention

This invention relates to an improved process for burning a fuel containing sulfur. More particularly, the invention relates to a process for burning a fuel wherein non-toxic sulfur compounds are formed.

2. Background Art

The combustion of fuels containing sulfur as well as incombustible ash-forming residues results in the need to control emission of particulates and sulfur gases, as well as provide for satisfactory disposal of residues, for environmental reasons. Since these sulfur gases, particulates and residues, including toxic residues, may constitute significant environmental hazards, much work has been devoted to the development of methods for preventing formation of these substances or cleansing them from the combustion gases.

With respect to the presence of sulfur in the fuel, it has been proposed to add materials to the fuel which will, at least at the combustion temperature, react with the sulfur to form sulfur compounds which may be removed, i.e., to prevent or mitigate the formation of sulfur oxide gases. Spurrier U.S. Pat. No. 1,007,153 proposed the addition of a salt, hydrate or oxide of one of the alkali metals as an additive to coke whereby the alkali would be carried into the pores of the coke where it may react with the sulfur upon heating to form sulfates and sulfides.

Trent U.S. Pat. No. 1,545,620 described saturating pulverized coke with water and comingling this with a mixture of pulverized limestone and hydrocarbon oil to form a plastic mass in which there is a close association between the sulfur and the limestone. When the mixture is coked, the limestone and sulfur react to form calcium sulfide.

McLaren et al U.S. Pat. No. 3,540,387 describes the addition of a carbonate, such as calcium carbonate, to a fluidized bed containing coal so that the sulfur is retained in the bed.

Robison et al U.S. Pat. No. 3,717,700 describes the use of a sulfur acceptor material in a first combustion zone to absorb the sulfur and then release it in a second zone to therefore concentrate most of the sulfur oxides in a small fraction of the flue gas.

Wall U.S. Pat. No. 4,102,277 describes incinerating sewage which has been dewatered with the aid of lime and then incinerated using high sulfur fuel. During incineration, the lime reacts with the sulfur in the furl and with oxygen to form calcium sulfate for disposal and to prevent formation of polluting sulfur oxide gases.

Dickinson U.S. Pat. No. 4,241,722 describes a process wherein a carbonaceous fuel containing sulfur is burned at elevated temperature and pressure conditions such that oxides of nitrogen and sulfur are not formed and sulfur in the fuel oxidizes to the trioxide which dissolves in the alkaline liquid phase. An alkali is used as a catalyst and to also neutralize acids (principally sulfur) formed during the combustion. When water soluble salts are formed, they may be treated with lime or limestone to convert them into comparatively insoluble calcium salts.

It is also known to mix fuel with an additive to control or alter the melting or softening point of the ash or slag formed to facilitate removal thereof. Barba U.S. Pat. No. 1,167,471 discloses the addition of clay to powdered coal to raise the melting point of the ash to form a more satisfactory coating on metals being heat treated.

Benner et al U.S. Pat. No. 1,955,574 adds a reagent to coal to alter and/or control the melting or softening point of the slag to protect the furnace walls from molten slag. The softening point of coal ash is said to be raised by the addition of sand or a non-ferruginous clay or lowered by the addition of lime or soda. The melting or softening point is controlled by the patentee to permit the build-up of a thin layer of solid slag on the furnace walls to protect the refractory walls from molten slag which is formed in the interior of the furnace.

Romer et al U.S. Pat. No. 2,800,172 relates to the addition of a metal or a metal oxide, e.g., aluminum, magnesium or calcium, to a liquid fuel to alter the form of slag produced in a combustion chamber to an easily removed slag.

The controlling of the combustion temperature to insure the production of a molten slag to thereby reduce airborne particulates is also known. Jonakin U.S. Pat. No. 3,313,251 describes a method for processing coal slurries containing crushed coal and water wherein the temperature in the furnace is maintained above the melting point of the ash in the coal so that a molten residue is produced by the combustion process. The centrifugal action produced in a cyclone furnace causes this residue to impinge on the furnace walls where, under the influence of gravity, it flows to the bottom of the furnace where it may be removed.

It is also known to burn fuel in more than one stage to reduce smoke and sulfur oxide production by providing an air-fuel ratio in the first stage less than that for stoichiometric burning. Fraser et al U.S. Pat. No. 3,228,451 proposed burning fuel in such a two-stage process wherein the fuel was burned in a first stage at an air-fuel ratio less than that for stoichiometric burning. The products of this combustion were then cooled and subsequently burned in a second stage with an excess of air which resulted in a lowering of the burning temperature.

Barsin et al U.S. Pat. No. 4,144,017 proposed burning fuel in several stages wherein the combustion air delivered to a primary furnace was regulated to introduce 50 to 70% of total stoichiometric air while maintaining the maximum combustion temperature at or below 2500° F. to reduce the formation of nitric oxides. The combustion air delivered to the second stage or secondary furnace is also regulated to introduce 50 to 70% of total stoichiometric air to the second furnace while maintaining a combustion temperature at or below 2900° F.

In my previous patent, U.S. Pat. No. 4,232,615, assigned to the assignee of this invention, a process was disclosed for burning a pulverized carbonaceous material containing sulfur and ash wherein an additive was used capable of reacting during combustion with the sulfur in the material, and the fuel was burned in two stages where the first stage contained less than 100% of the theoretical air and was preferably at a temperature below 1100° C. to thereby inhibit the formation of undesirable sulfur oxide gases and to assist in the removal of the sulfur as solid compounds. It was proposed therein that the first stage could be maintained at a temperature either below or above the melting point of the ash, depending upon the desired conditions. It was further suggested that the additives used for reacting with the sulfur to form sulfur compounds might also have an effect upon the overall melting point of the ash either reducing or raising it, depending upon the particular compound used.

If the fuel mix is burned in the first stage with less than 100% theoretical air at a temperature below the melting point of the ash, as in the aforementioned Brown patent, the sulfur removal is good both from the standpoint of the limitation of air aiding in the formation of thermally stable sulfide compounds rather than sulfites, and the reduced temperature preventing any sulfite compounds formed from decomposing to undesirable sulfur oxide gases. In addition, the reaction between the additives and sulfur is enhanced by the large surface area of the fine particulate particles. Furthermore, the reduced temperature reduces the formation of oxides of nitrogen as well.

However, the formation of sulfides, while preventing formation of undesirable sulfur oxide gases in the gas stream presents a disposal problem because the resultant ash and sulfur compounds removed from the combustion zone contain leachable sulfides. Such sulfides, if contacted by water such as ground water in landfills, can form toxic hydrogen sulfide.

Thus, operation of the prior art processes represented a compromise at best wherein the elimination of sulfur emissions, under conditions not favoring production of oxides of nitrogen, can produce toxic solid sulfur compounds, thus complicating disposal of solid residues from the combustion process. It would, therefore, be highly desirable to provide a process wherein both the problem of sulfur oxide and nitrogen oxide emissions and the problem of production of toxic solids were addressed.

SUMMARY OF THE INVENTION

It is, therefore, an object of this invention to provide a process for burning combustible fuel containing sulfur and ash-forming materials wherein the emission of particulates and sulfur-bearing gases is reduced while forming non-toxic solid sulfur compounds.

It is another object of this invention to provide a process for burning combustible fuel containing sulfur and ash-forming materials wherein the emission of particulates and sulfur-bearing gases is reduced by providing a stage which converts toxic sulfides to non-toxic sulfates.

These and other objects of the invention will be apparent from the following description and accompanying drawings.

In accordance with the invention, a combustion process for burning a fuel containing sulfur characterized by low sulfur emission and good ash removal comprises: mixing the sulfur containing fuel with an additive capable of reacting with sulfur; burning the mixture in a first combustion stage with less than 75% theoretical air and at a temperature below the melting point of the ash, but sufficiently high to cause reaction between the additive and any sulfur in the fuel to facilitate removal of the sulfur compounds formed; passing combustible fuel gases and particulates from the first stage to one or more further stages to complete the combustion of the fuel; and oxidizing, in a separate zone, sulfur compounds formed by reaction between the additive and the sulfur in the fuel to form non-toxic sulfates.

DESCRIPTION OF THE PREFERRED EMBODIMENTS

Figure 1:
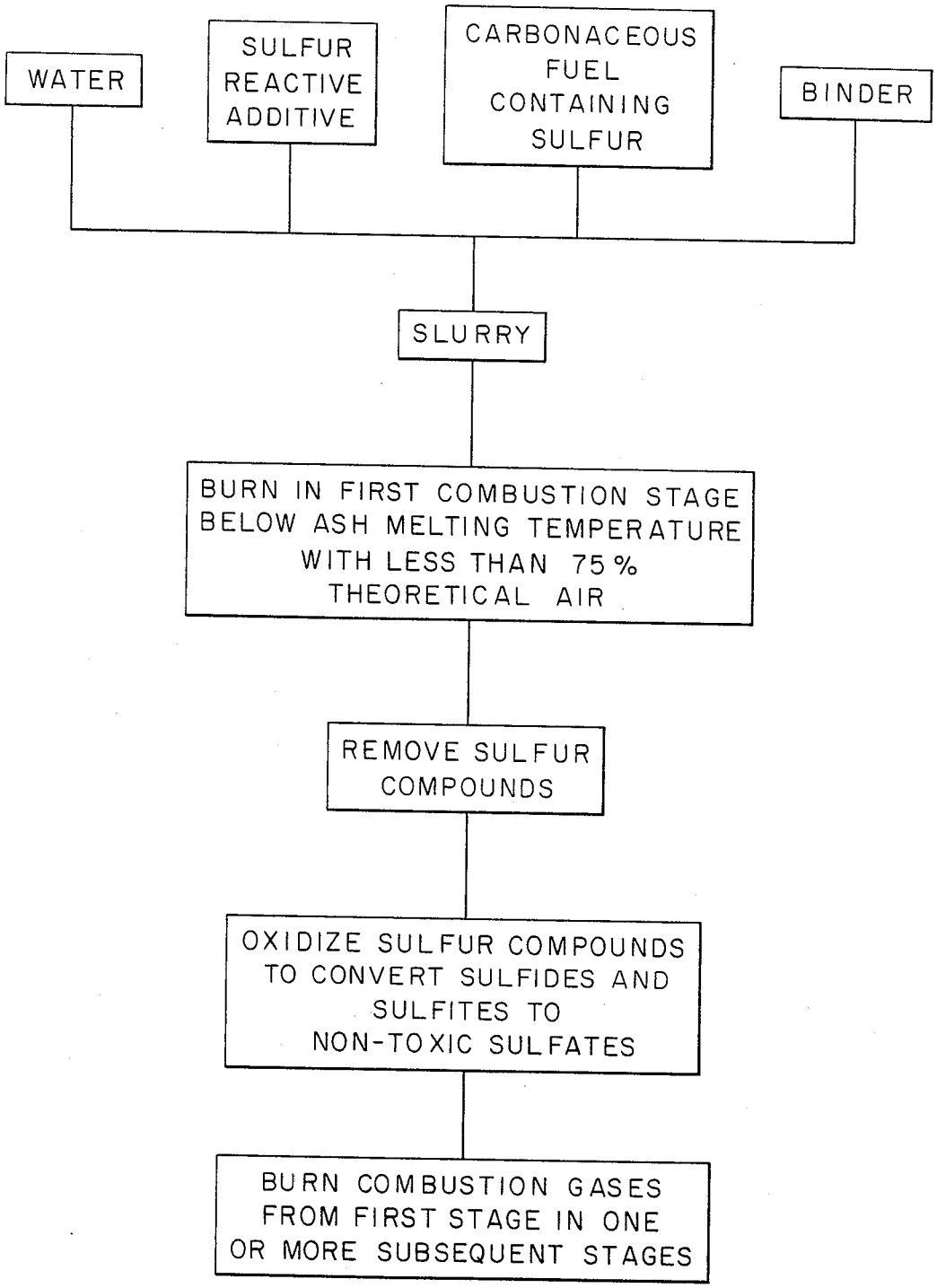
FIG. 1 is a flow sheet illustrating the process of the invention.

In the practice of the preferred embodiment of the invention, the fuel containing sulfur and ash-forming materials is mixed, prior to combustion, with an additive capable of reacting during combustion with the sulfur in the fuel. The fuel mix is then burned in a first combustion zone with less than 75% theoretical air. The resultant sulfur compounds, formed in the first combustion zone, are then removed and oxidized in a separate zone to form non-toxic sulfates.

The fuel may comprise a dry, coarsely ground, coal, i.e., $\frac{1}{4}$ to $\frac{1}{2}$ inch particles; a dry, pulverized coal, i.e., having an average particle size of −200 mesh (Tyler); or the pulverized coal may be mixed with water to form a slurry to facilitate intimate contact with the additives.

The use of water in the fuel mix to form a slurry, while not necessary, provides several important advantages. It acts as a vehicle for the fuel when particulate coal is used allowing it to be handled as a liquid or as a stiff paste. It also promotes the intimate association of the additive with the particulate carbonaceous material that is necessary to maximize the effect of the additive by bringing the additive and the sulfur in the carbonaceous material in intimate associationship with one another. A water based slurry may also be stored without fear of spontaneous combustion or excessive dust generation.

The additive capable of reacting with sulfur in the fuel may comprise a material containing a metal, including an alkali metal or an alkaline earth metal, capable of reacting with sulfur to form a compound. The metal may be in metallic form, a salt or an oxide. Examples of such materials include calcium oxide, calcium carbonate, dolomite, magnesium oxide, sodium carbonate, sodium bicarbonate, iron oxide and clay. The inclusion of the particular additive in the initially formed fuel mix may also alter the melting point of the subsequently formed ash.

Certain additives, such as calcium oxide, calcium carbonate, dolomite and magnesium oxide may act to increase the melting temperature of the ash while sodium carbonate, sodium bicarbonate and clay may act to decrease the melting temperature of the ash. Under certain circumstances, it may be desirable to utilize an additive mixture comprised of a mixture of these preferred materials.

If the fuel mix also contains a particulate binding agent, reduced particulate emission during combustion may be achieved. This may be due to a binding of the carbonaceous particles that occurs when the binding agent is present in the fuel mix during the initial heating thereof in the first stage combustion chamber prior to combustion. Preferred binding agents for addition to the slurry include clay, sucrose, calcium acetate and acetic acid.

The fuel mix may be blown into the first stage combustion chamber by a high velocity stream of air when a dry fuel mix is used. If a slurry is used, the fuel mix may be fed into the first stage combustion chamber by a suitable feed mechanism, such as a mechanical screw device or the like, or blown in dispersed as small droplets. In the first combustion zone, the fuel mix is burned in the presence of less than 75%, or in some instances, less than 50% of the theoretical air needed for complete combustion. When coarse particles are used, a fluidized bed combustor may be utilized in the first stage.

The temperature is controlled in the first stage of combustion to maintain the temperature at from 700°-1100° C. and, preferably at a temperature between 850° and 1100° C. At these temperatures, a reaction between the fuel mix constituents and the oxygen in the air of combustion forms sulfur compounds, such as hydrogen sulfide, carbonyl sulfide and sulfur dioxide. These compounds, in turn, may then react with the additive to form sulfides and sulfites. Some of the sulfites thus produced are thermally unstable at high temperatures. Thus, for example, calcium sulfite begins to decompose to calcium oxide and sulfur dioxide at about 900° C., and it is almost completely unstable at temperatures above 1100° C. Therefore, since the invention contemplates the removal, as solids, of the compounds formed by reaction of the additive with the sulfur, it is desirable that the temperature be maintained low enough to prevent such decomposition and formation of sulfur-bearing gases.

The temperature may be maintained below 1100° C. during combustion by introducing steam into the chamber with the combustion air, or more preferably, by the limitation of the amount of air introduced into the chamber. It should be noted in this regard that localized hot spots may exist in the chamber at temperatures above 1100° C. In the presence of such hot spots, it is still considered to be within the perview of maintaining the overall temperature of the chamber below 1100° C. as it may be almost impossible to eliminate such hot spots.

Maintaining the temperature in the first stage below the melting point of the ash also assists in the reaction between the sulfur and the additive in the fuel mix by providing a larger surface area for reaction that would be present if molten slag was formed in the first reaction zone.

Limitation of the amount of air introduced into the first chamber to less than 75% theoretical air, and, in some instances, less than 50%, has the added benefit of causing the major portion of the sulfur and the carbonaceous material to form sulfides with the additive, e.g., calcium sulfide or iron sulfide, which are thermally stable at the temperatures used in the first stage of the combustion. Thus, the emission of sulfur oxides may be significantly reduced by limitation of the amount of air introduced into the first stage combustion chamber to less than 75% theoretical air. The operation of the first stage combustion chamber with less than 75% theoretical air also reduces the formation of oxides of nitrogen. The use of preheated air may result in the need for even less air to achieve the same combustion temperatures.

In accordance with the invention, the solid materials formed in the first stage of the combustion, consisting principally of the reaction products of the additive and the sulfur in the fuel and ash products, are removed as solids from the bottom of the first combustion chamber and passed to an oxidation zone, as will be described below.

The hot combustion gases, together with at least the fine ash not removed from the first stage, are passed through a flue into one or more further combustion zones wherein they are burned to completion with an excess of air. By the time the combustion gases reach the last zone or stage, the fuel values in the combustible gases should be substantially free of any sulfur or ash-forming materials; therefore, this stage may be operated to maximize the burning of any remaining combustible fuel values in the gas.

The solid materials removed from the first combustion zone are contacted, preferably while still hot, with enough air in an oxidation furnace to convert substantially all sulfide and sulfite compounds therein into non-toxic sulfates.

Thus, for example, when the fuel mixture additive comprises a calcium-containing compound, such as calcium oxide or calcium hydroxide, calcium sulfide may be formed in the first combustion zone due, at least in part, to the low oxygen content in this zone which suppresses formation of gaseous oxides of nitrogen or sulfur. If this calcium sulfide were disposed of in a landfill and subsequently contacted by ground water, toxic hydrogen sulfide could be formed and leached out by the water.

In accordance with the invention, however, sulfide compounds, such as calcium sulfide, are oxidized to form the non-toxic sulfate in the oxidation zone. Calcium sulfate is relatively insoluble and, in any event, does not possess the toxicity of calcium sulfide nor the ability to generate hydrogen sulfide.

The hot products from the first reaction zone are oxidized in the oxidation zone, preferably for a period of from 0.1 to 10 minutes, but, in any event, a sufficient period of time to provide at least 95 wt. % conversion to the sulfate. Preferably, the compounds are oxidized while hot, and most preferably with hot air, i.e., air heated to a temperature of 300° to 500° C. The hotter the products and the air, the shorter will be the required residence time needed in the oxidation zone. The resulting sulfate products are then removed from the oxidation zone and disposed of.

Figure 2:
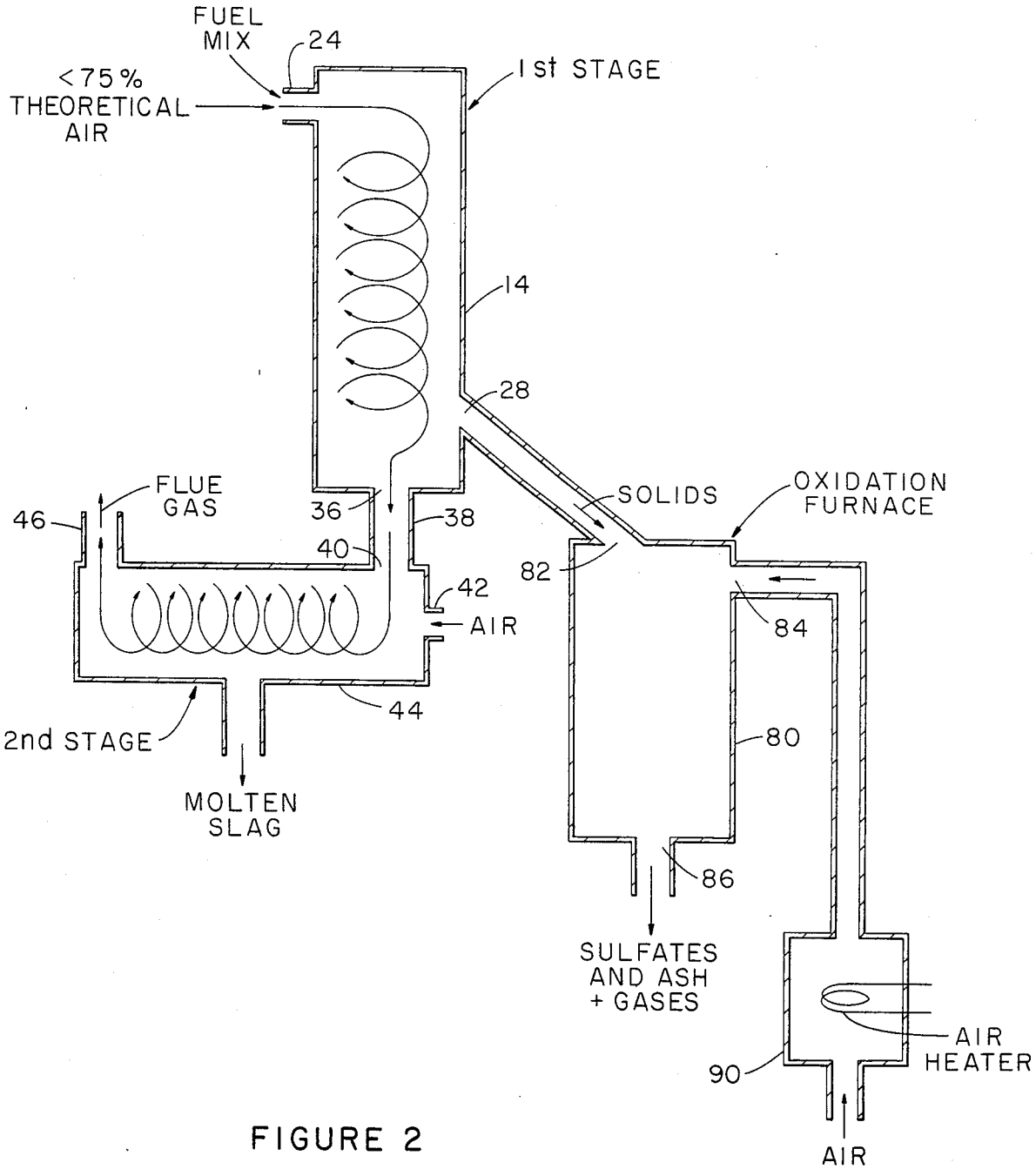
FIG. 2 is a cross-sectional schematic illustrating a preferred apparatus useful in the practice of the invention.

Referring now to FIG. 2, a combustion apparatus is schematically depicted for practice of the method of this invention. The apparatus includes a first stage combustion chamber 14 and a second stage combustion chamber 44.

The fuel mix, including the fuel and additives, as well as air for combustion in the dirst stage, enter chamber 14 at inlet 24. As has been mentioned, less than 75% theoretical air is supplied in the first stage, preferably in such a way as to maintain the temperature therein below about 1100° C., and preferably at about 850° C. to 1050° C. During combustion, the additive in the fuel slurry will combine with sulfur in the fuel to form compounds which will accumulate in the form of solids in the bottom of the chamber.

As these compounds accumulate during the first stage of combustion, they are removed from chamber 14 through a port 28 together with at least large particles of ash resulting from ash-forming materials present in the fuel. The combustible gases from chamber 14 exit at outlet 36 and pass through conduit 38 to second stage combustion chamber 44. Entering this chamber at inlet 40, these gases are mixed with additional air through an air inlet 42 wherein combustion is completed. The exhaust from chamber 44 exits through exhaust outlet 46 for discharge to the atmosphere or further treatment, depending upon the amount of gases or particulates passing through outlet 46.

The hot solids removed at port 28 are moved into an oxidation chamber 30 through a port 82. The hot solids are contacted with air, preferably preheated at 90, which enters chamber 80 at port 84 to contact the solids passing into the top of chamber 80 via port 82.

After reacting to at least 90 to 95 wt. % or more completion, the newly formed sulfate compounds, as well as ash residues, are removed from oxidation chamber 80 at exit port 86 for subsequent disposal.

Thus, the process of the invention provides a combustion process for a fuel mix wherein sulfur compounds are formed from sulfur in the fuel mix and removed in a first combustion stage. These sulfur compounds are then oxidized to convert any sulfides or sulfites into stable, non-toxic sulfates. The remaining combustion gases from the first combustion stage are then burned in one or more subsequent stages.

Having thus described the invention, what is claimed is:

1. A combustion process for burning a fuel containing sulfur characterized by low sulfur emission, good ash removal and the production of non-toxic sulfur compounds comprising:

(a) mixing the sulfur containing fuel with an additive capable of reacting with sulfur;

(b) burning the mixture in a first combustion stage with less than 75% theoretical air and at a temperature below the melting point of the ash but sufficiently high to cause reaction between said additive and any sulfur in said fuel to facilitate removal of the sulfur compounds formed;

(c) removing solid materials from said first stage, including sulfur compounds formed therein;

(d) oxidizing said solid materials in an oxidation zone at a temperature and time sufficient to convert about 90 to 95 wt. % of the sulfides and sulfites in said solid materials to non-toxic sulfate compounds; and (e) burning combustible gases from said first stage in one or more subsequent stages to ensure complete combustion of said fuel.

2. The process of claim 1 wherein said particulate carbonaceous fuel comprises coal and said temperature in said first stage is maintained below 1100° C. to prevent ash formed by said burning coal from melting whereby reaction between said additive and sulfur in said fuel in said first stage to form sulfur compounds is facilitated.

3. A combusion process for burning a fuel containing sulfur characterized by low sulfur emission, good ash removal, and the production of non-toxic sulfur compounds comprising:

(a) mixing the sulfur containing fuel with an additive capable of reacting with sulfur;

(b) burning the mixture in a first combustion stage with less than 75% theoretical air and at a temperature below the melting point of the ash but sufficiently high to cause reaction between said additive and any sulfur in said fuel to facilitate removal of the sulfur compounds formed;

(c) removing solid materials from said first stage, including sulfur compounds formed therein;

(d) oxidizing said solid materials by contacting said materials with air preheated to a temperature of at least 300° C. in an oxidation zone maintained at a temperature and time sufficient to convert 90–95 wt. % of the sulfides and sulfites in said solid materials to non-toxic sulfate compounds; and (e) burning combustible gases from said first stage in one or more subsequent stages to ensure complete combustion of said fuel.

4. A combustion process for burning a fuel containing sulfur characterized by low sulfur emission, good ash removal, and the production of non-toxic sulfur compounds comprising:

(a) mixing the sulfur containing fuel with an additive capable of reacting with sulfur to form metal sulfides and metal sulfites;

(b) burning the mixture in a first combustion stage with less than 75% theoretical air and at a temperature maintained below 1100° C. to prevent ash formed by said burning coal from melting but sufficiently high to cause reaction between said additive and any sulfur in said fuel to form said metal suffides and metal sulfites;

(c) removing solid materials from said first stage, including said metal sulfur compounds formed therein;

(d) oxidizing said solid materials in an oxidation zone at a temperature and time sufficient to convert 90–95 wt. % of said metal sulfides and metal sulfites in said solid materials to non-toxic metal sulfate compounds; and (e) burning combustible gases from said first stage in one or more subsequent stages to ensure complete combustion of said fuel.

5. The process of claim 4 wherein said step of mixing said sulfur containing fuel with an additive capable of reacting with said sulfur to form metal sulfides and metal sulfites further comprises mixing said sulfur containing fuel with a calcium compound capable of reacting with said sulfur to form calcium sulfide and calcium sulfite; and said step of oxidizing said solid materials to convert 90–95 wt. % of said metal sulfides and metal sulfites in said solid materials to non-toxic metal sulfate compounds comprises oxidizing said calcium sulfide and calcium sulfite to form calcium sulfate.

6. The process of claim 3 wherein said materials removed from said first reaction zone are contacted with air while said materials are still hot.

7. The process of claim 4 wherein the step of oxidizing said solid materials formed in said first reaction zone is carried out at a temperature from 500° to 1100° C.

8. The process of claim 7 wherein the step of oxidizing said solid materials is carried out for a time of from 0.1 to 10 minutes.

* * * * *